United States Patent [19]

Paris, Jr. et al.

[11] 4,167,961

[45] Sep. 18, 1979

[54] PLANER AND GROOVER

[75] Inventors: Alfonso A. Paris, Jr.; Douglas W. Muscanell, both of South Hill, Va.

[73] Assignee: New England Log Homes, Inc., Hamden, Conn.

[21] Appl. No.: 895,924

[22] Filed: Apr. 13, 1978

[51] Int. Cl.[2] ..... B27C 9/04

[52] U.S. Cl. ..... 144/3 R; 83/102.1; 83/444; 144/116; 144/136 R; 144/326 R

[58] Field of Search ..... 83/102.1, 156, 422, 83/444; 144/3 R, 36, 37, 41, 114 R, 116, 134 R, 136 R, 246 R, 246 D, 1 R, 39, 117 R, 323, 326 R

[56] References Cited

U.S. PATENT DOCUMENTS

| | | | |
|---|---|---|---|
| 220,299 | 10/1879 | Metcalf | 144/37 |
| 366,841 | 7/1887 | Johnson, Jr. | 144/37 |
| 3,487,866 | 1/1970 | Mitten | 144/312 |
| 3,841,367 | 10/1974 | Vizziello et al. | 144/39 |

*Primary Examiner*—Robert Louis Spruill
*Assistant Examiner*—W. D. Bray
*Attorney, Agent, or Firm*—DeLio and Montgomery

[57] ABSTRACT

A machine for planing and grooving a workpiece, such as a log, in a single pass, comprising a frame, a top grooving cutter adjacent one end of the frame, a top planing cutter and a bottom planing cutter in the frame, and a bottom grooving cutter adjacent the other end of the frame, with feed rolls ahead of the planing cutters, guide vanes in back of each grooving cutter and a back-up roll opposite each planing cutter. Suitable feed and delivery tables are provided, together with preliminary alignment guidance devices including guide pins in the feed table.

7 Claims, 12 Drawing Figures

20
22
23
14
24
VI
VI
26
25
31
30
32
33
34
35
37
36
38
39
40
W
41
42
43
VII
VII
44
43

38
39

24
42
44
W 25
24
26
W

9
W
14
12
20
M1
22
10
26
25
23

W

PLANER AND GROOVER

This invention relates to a planing and grooving machine which is adapted for top and bottom planing and grooving of a workpiece, such as a log, in a single pass, the several cutters being mounted sequentially in a frame and supplemented by guide, feed and back-up rolls and other guiding devices.

The machine may be regarded as an improvement on the planing and grooving machine disclosed in Vizziello and Bouteiller U.S. Pat. No. 3,841,367, Oct. 15, 1974, wherein the background of this invention is fully discussed and a machine is disclosed wherein each planing cutter is provided with a grooving blade adapted to form a narrow groove in the surface being planed. Machines of that type have been used successfully for some time but have been found to present certain difficulties which are overcome in the present machine. According to the patent, four operations—top and bottom planing and top and bottom grooving—are performed on the work within a very short linear distance. This makes for economy of manufacturing space but may, it is believed, contribute to vibrational problems. Furthermore, the grooving blades, carried by the planing cutter rolls, are in the middle of the machine where replacement and repair can be effected only with great inconvenience, such as the need to remove entirely one or more rolls and/or other parts of the machine.

It is accordingly an object of the present invention to provide a planing and grooving machine wherein the several planing and grooving elements, while mounted on a single frame, are so located as to be each readily accessible for inspection, repair or replacement.

It is another object of the invention to provide a planing and grooving machine wherein the planing and grooving rolls, as well as guide and feed rolls, are disposed in a sequence and location such that vibration is minimized.

It is a further object of the invention to provide a planing and grooving machine with feed and delivery tables adapted to maintain the correct alignment of the workpiece from the time it enters the machine until it exits from the last grooving cutter.

It is yet another object of the invention to provide certain improvements in the form, construction and arrangement of the several parts whereby the above-named and other objects may effectively be attained.

The invention accordingly comprises the features of construction, combinations of elements and arrangement of parts which will be exemplified in the constructions hereinafter set forth, and the scope of the invention will be indicated in the claims.

A practical embodiment of the invention is shown in the accompanying drawings, wherein.

Figure 1:
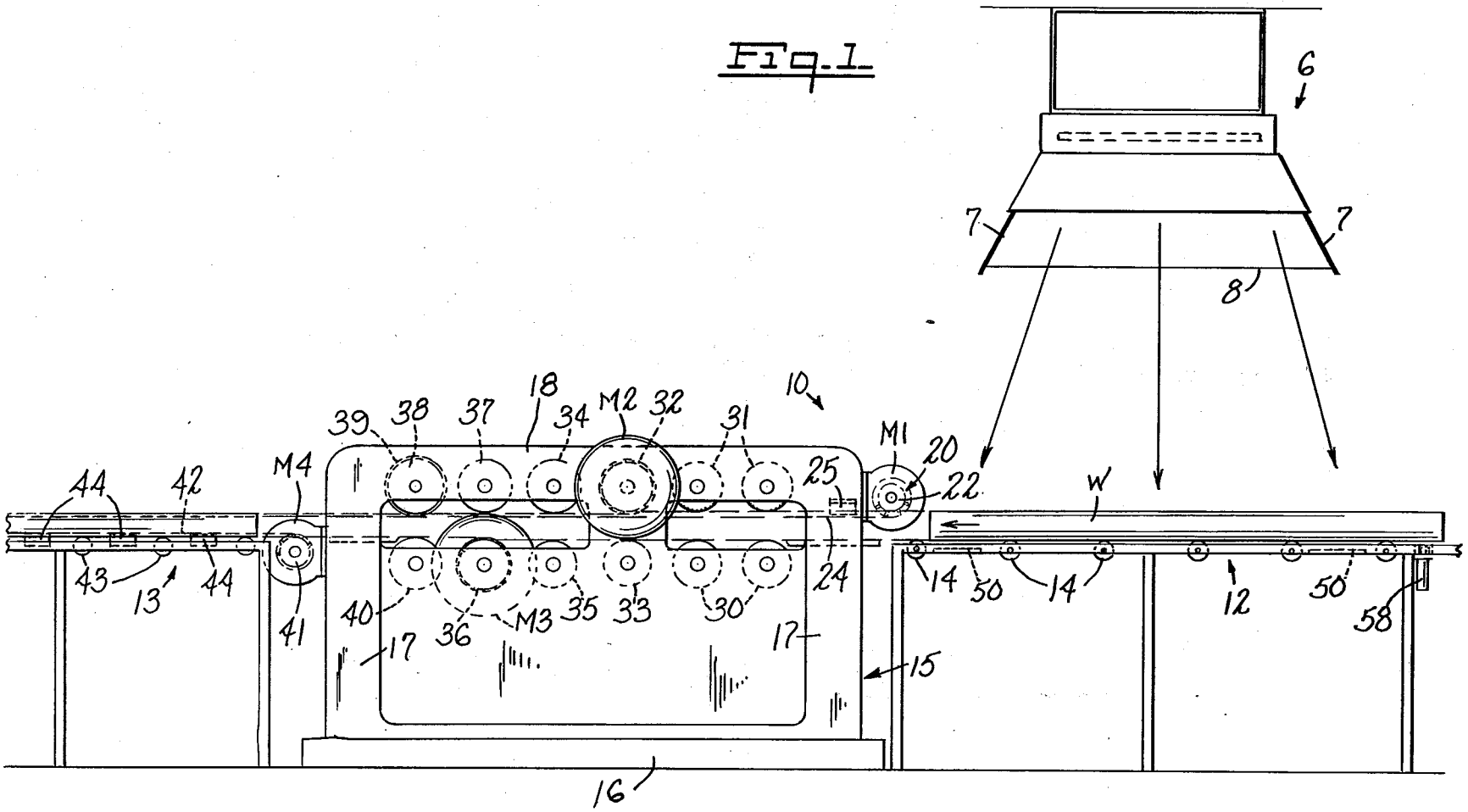
FIG. 1 represents a partly diagrammatic side elevation of the machine, including one form of alignment apparatus.

Referring to the drawings, the planing and grooving machine 11 is shown in conjunction with a feed table 12 and a delivery table 13. The feed table is equipped with idler rolls 14 along which the workpiece W may be manually or mechanically propelled from right to left in FIG. 1. The workpiece is, for present purposes, understood to be a log which has been debarked and sawed to provide substantially flat and parallel top and bottom surfaces.

At the right of FIG. 1 there is shown log alignment apparatus including a shaded lamp 6 from which is supported by depending brackets 7 a wire 8, oriented to cast a shadow 9 (FIG. 3) of the wire onto the feed table 12 in alignment with the cutting edges of the top grooving cutter 20. The shadow 9 will thus be cast on the upper surface of the log W when the log is on the feed table, so that the log can be accurately aligned with the cutter and manually retained in such alignment at least during the initial stages of groove cutting. This alignment apparatus is commercially available and is disclosed also in the Vizziello et al. patent cited above.

The machine frame 15 comprises a base 16, end posts 17 and an upper roll support beam 18. The lower roll support and adjustment means are conventional and the specific details thereof are not shown. The opposite side of the frame is similar.

Figure 2:
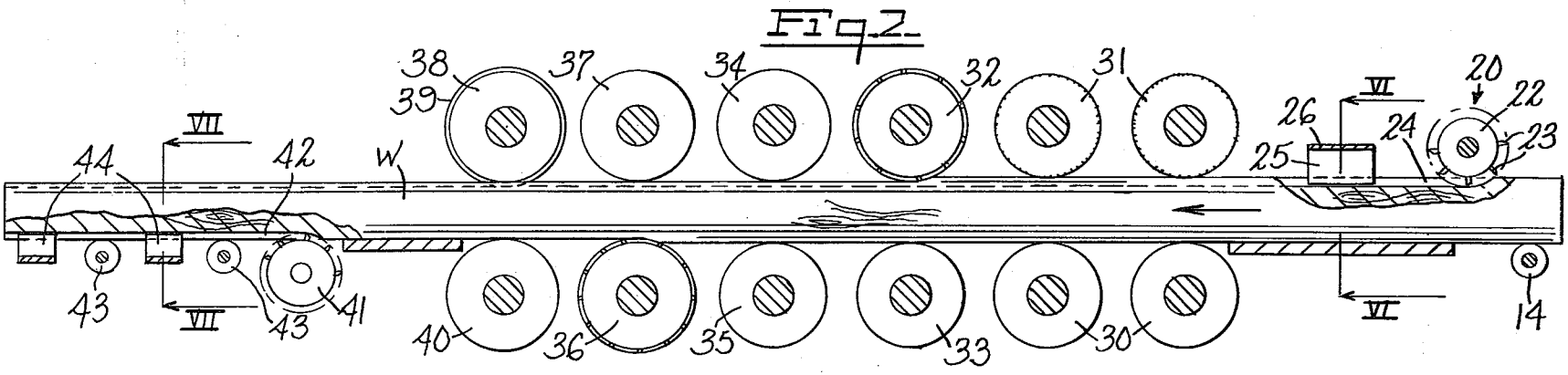
FIG. 2 represents a partly diagrammatic longitudinal section.
Figure 4:
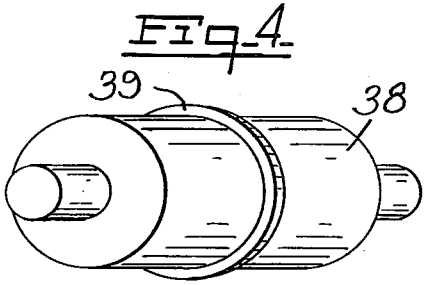
FIG. 4 represents an isometric view of a ridged guide roll.
Figure 7:
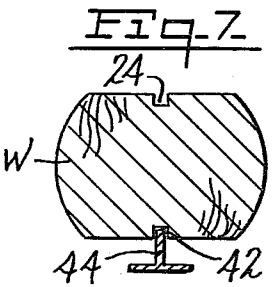
FIG. 7 represents a vertical section on the line VII—VII of FIG. 2.

At the inlet end of the machine there is mounted the top grooving cutter 20, driven by the motor M-1, the cutter being in the form of a disc 22, from which protrude a series of radially disposed teeth 23, as indicated in FIG. 2. The cutter rotates clockwise, as viewed in FIGS. 1 and 2, facilitating advancement of the log and cutting therein a groove 24 having a fixed width and depth. The grooving cutters are shown outside the profile of the frame for convenience of illustration; in practice a location between the end posts 17 has been found suitable.

Figure 6:
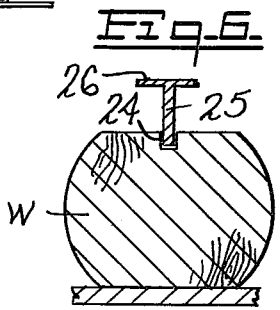
FIG. 6 represents a vertical section on the line VI—VI of FIG. 2.

Immediately downstream from the cutter 20 is located a guide plate 25 (FIGS. 2 and 6), carried by a bar 26 which is fixed to the frame of the machine, the plate being sized and placed so as to project into the groove 24 and to extend linearly therein at least a few inches. The plate is aligned with the cutter 20 and is so close thereto that the newly cut groove, at the entering end of a log, registers easily with the plate.

As the log advances through the machine it is supported by lower idler rolls 30 and driven by drive rolls 31 having knurled or otherwise roughened surfaces and being driven by a motor, not shown. Beyond the drive rolls is the upper planing roll 32 which is a cylinder having radially projecting blades, driven at a suitable high speed by a motor M-2, and the work being held securely in position by the lower back-up roll 33. The upper and lower rolls 34, 35 are idlers, between the upper planing roll and the lower planing roll 36 with its upper back-up roll 37, this planing roll being the same as the upper one and driven by its own motor M-3. Next in sequence is the upper guide roll 38 which has an annular ridge 39, adapted to fit in the upper groove 24 to maintain the completely planed log in proper alignment as it passes over the lower idler roll 40 to the bottom grooving cutter 41, which is the same as the cutter 20, driven by motor M-4, and is adapted to form the longitudinal groove 42.

The completely grooved and planed log passes across the delivery table 13 on idler rolls 43, being still guided by one or more lower guide plates 44, located in line with the bottom grooving cutter in positions to engage in the newly formed lower groove as the log advances.

Figure 3:
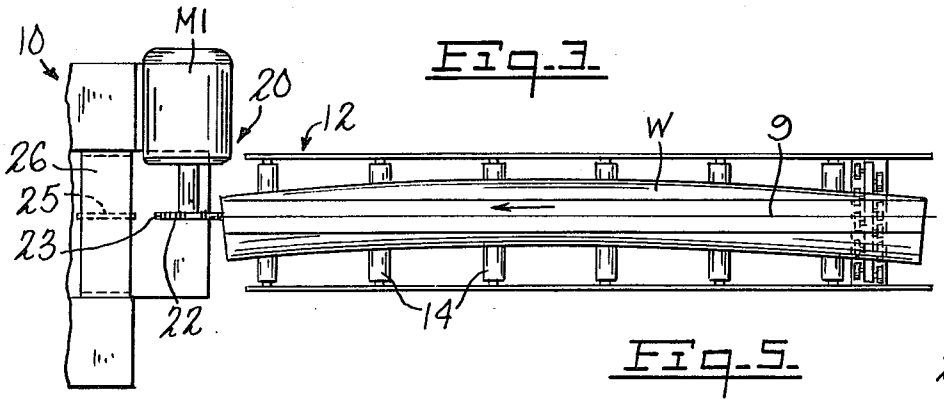
FIG. 3 represents a detail top plan view of a workpiece approaching the top grooving cutter, some log guiding and manipulating elements being omitted.
Figure 5:
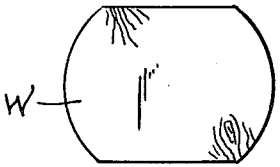
FIG. 5 represents an end view of a workpiece sawed on two opposite sides.
Figure 10:
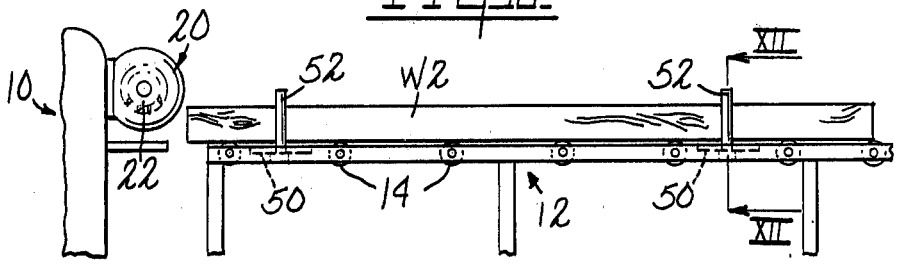
FIG. 10 represents a detail elevation of a portion of the feed table illustrating the use of guide pins.
Figure 11:
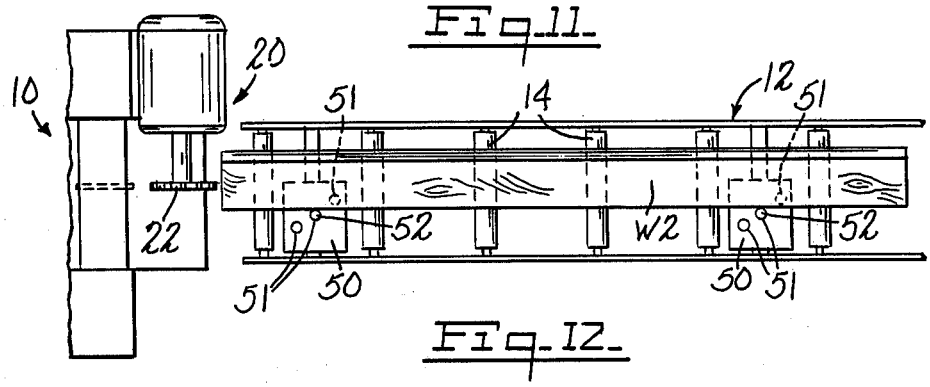
FIG. 11 represents a plan view of the elements shown in FIG. 10.
Figure 12:
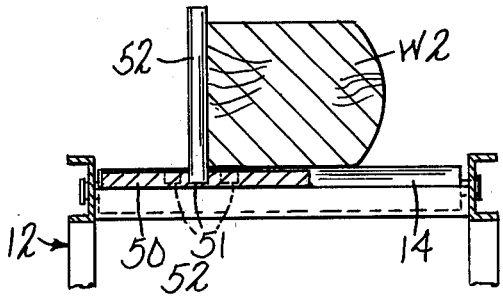
FIG. 12 represents an end view of the log shown in FIGS. 10 and 11, and supporting and guiding elements therefor, parts being in section and parts cut away.

In some instances, the basic workpiece $W^2$ is a log which has been sawed flat on three sides, as shown in FIGS. 10, 11 and 12, in which case the vertical surface can be used as a reference for orientation purposes, without resort to the wire shadow discussed in connection with FIGS. 1 and 3. For this purpose the feed table is equipped with flat plates 50 spaced a few feet apart with their upper surfaces below the top level of the idler rolls, each plate having a plurality of holes 51 arranged at precise locations relative to the vertical plane of the grooving cutter. When steel guide pins 52 are inserted in corresponding holes in the respective plates they define a vertical plane which is offset by a given distance (e.g., two, three or four inches) from the plane of the cutter and its parallel thereto. A log $W^2$ which is held with its vertical sawed side against the guide pins, as it advances to the cutter, is thus assured of precise orientation which is continued by engagement of the guide plate 25 in the newly cut groove upon further advancement of the log. The pins are removed when a log W, without a flat third side, is to be grooved and planed.

Figure 8:
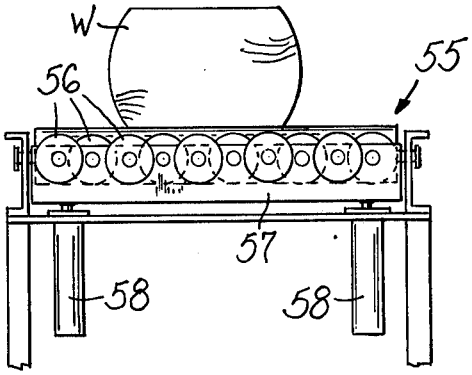
FIG. 8 represents an end view of a feed table showing an elevation of a log locating transverse roll carriage in inactive position.
Figure 9:
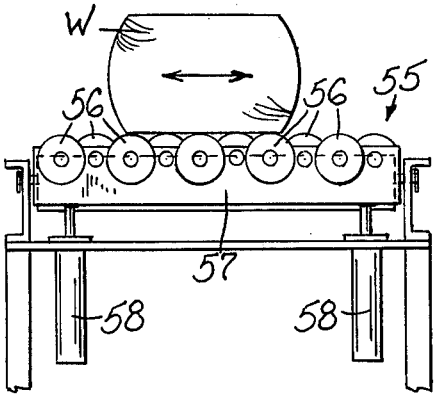
FIG. 9 represents a view as in FIG. 8 showing the roll carriage in raised position.

It is convenient to deliver the sawed logs to the feed table laterally, as by means of a chain conveyor terminating at one side of the feed table, where the logs can be deposited one at a time on the rolls. At this point, manual relocation of each log is needed, either to align its upper surface properly with the shadow 9, as described above, or to place a vertical sawed side firmly against the guide pins 52. Such manipulation is facilitated by the provision of a transverse roll assembly 55 comprising an array of rolls 56 mounted on each side of a carriage 57 extending across the width of the feed table, preferably at a point upstream from the first guide pin plate 50. The carriage 57 is fixed to the pistons of a pair of hydraulic or pneumatic cylinders 58 so that it can be lifted to a level (FIG. 9) such that it holds a log above the feed rolls and can serve as a rolling fulcrum for a log supported thereby. If the log is supported somewhere near its mid-point it can be rather easily maneuvered into its desired initial position on the feed table, whereupon the transverse rolls are lowered (FIG. 8) to await delivery of the next log.

While all of the features described herein are suitably embodied in a single grooving and planing machine, it is apparent that some could be used in other wood working machines, as where accurate alignment of the work is required.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

We claim:

1. A log planing and grooving machine for planing and grooving opposite parallel sides of a workpiece having at least two opposite sides preliminarily sawed to provide parallel surfaces comprising, a machine frame having upstream and downstream ends, a top grooving cutter adjacent the upstream end of said frame, a top planing cutter, at least one drive roll between the top grooving cutter and the top planing cutter, a bottom planing cutter, a bottom grooving cutter adjacent the downstream end of the frame, a top guide roll having means for engaging the top groove in the workpiece said top guide roll being located at a position above and between the bottom planing cutter and bottom grooving cutter, a feed table with idler rolls aligned with the machine frame and adjacent the upstream end thereof, and a delivery table with idler rolls aligned with the machine frame and adjacent the downstream end thereof.

2. A log planing and grooving machine according to claim 1 which includes at least one vertically disposed guide element carried by the feed table for accurately aligning the workpiece with the top grooving cutter.

3. A log planing and grooving machine according to claim 2 which includes two vertically disposed elements and means carried by the feed table for supporting each of said elements in any one of a plurality of selected positions.

4. A log planing and grooving machine according to claim 3 wherein the guide elements are pins and the supporting means are plates each containing a plurality of holes adapted to receive the pins, and the holes being offset laterally from the vertical plane containing the top grooving cutter.

5. A log planing and grooving machine according to claim 1 which includes a roll assembly disposed transversely of the feed table and means for selectively raising and lowering said assembly to lift a workpiece temporarily out of contact with the feed table idler rolls.

6. A log planing and grooving machine according to claim 1 which includes a fixed guide element downstream from the top grooving cutter in a position to engage in the top groove in the workpiece.

7. A log planing and grooving machine according to claim 1 wherein the delivery table is provided with at least one fixed guide element in a position to engage in the bottom groove in the workpiece.

* * * * *